US010971859B2

(12) United States Patent
Tajima et al.

(10) Patent No.: US 10,971,859 B2
(45) Date of Patent: Apr. 6, 2021

(54) TWO CONNECTOR HOUSINGS, ONE WITH A LOCK ARM, THE SECOND WITH RATTLE PREVENTION RIBS

(71) Applicant: Sumitomo Wiring Systems, Ltd., Yokkaichi (JP)

(72) Inventors: Shingo Tajima, Yokkaichi (JP); Yukihiro Fukatsu, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/748,939

(22) Filed: Jan. 22, 2020

(65) Prior Publication Data

US 2020/0259296 A1 Aug. 13, 2020

(30) Foreign Application Priority Data

Feb. 7, 2019 (JP) ..... JP2019-020337

(51) Int. Cl.

| | |
|---|---|
| ***H01R 13/627*** | (2006.01) |
| ***H01R 13/64*** | (2006.01) |
| ***H01R 13/639*** | (2006.01) |
| ***H01R 13/502*** | (2006.01) |

(52) U.S. Cl.

CPC ..... *H01R 13/639* (2013.01); *H01R 13/502* (2013.01); *H01R 13/6272* (2013.01); *H01R 13/64* (2013.01)

(58) Field of Classification Search

CPC ..... H01R 13/6271; H01R 13/6272; H01R 13/64; H01R 13/6456; H01R 13/4368; H01R 13/502; H01R 13/629

See application file for complete search history.

(56) References Cited

U.S. PATENT DOCUMENTS 4,884,978 A * 12/1989 Inaba ..... H01R 13/6272 439/352
6,186,814 B1 * 2/2001 Matsushita ..... H01R 13/6271 439/271

FOREIGN PATENT DOCUMENTS

JP 2008-166046 7/2008

* cited by examiner

*Primary Examiner* — Vanessa Girardi
(74) *Attorney, Agent, or Firm* — Gerald E. Hespos; Michael J. Porco; Matthew T. Hespos

(57) ABSTRACT

A connector includes a first housing (10) and a second housing (60) connectable to each other. The second housing (60) includes two walls (64) facing each other. The first housing (10) includes a receptacle (12) defining a fitting space (14), two side walls (19) connected to both circumferential ends of the receptacle (12) and a lock arm (24) arranged between the side walls (19). Entrance spaces (29) into which the walls (64) enter are defined between the side walls (19) and the lock arm (24) to communicate with the fitting space (14). Protrusions (31, 32) configured to contact the walls (64) are provided on inner surfaces of the side walls (19).

4 Claims, 8 Drawing Sheets

TWO CONNECTOR HOUSINGS, ONE WITH A LOCK ARM, THE SECOND WITH RATTLE PREVENTION RIBS

BACKGROUND

Field of the Invention

The invention relates to a connector.

Related Art

Japanese Unexamined Patent Publication No. 2008-166046 discloses a connector with a female housing and a male housing that are connectable to each other. The male housing includes a receptacle, and a fitting groove having a trapezoidal cross-section is provided in the inner surface of the receptacle. The female housing includes a terminal accommodating portion fittable to the receptacle. A rattling preventing rib having a chevron-shaped cross-section is provided on the outer peripheral surface of the terminal accommodating portion. When the housings are connected, the rattling preventing rib is fit into the fitting groove, and base end parts of the rattling preventing rib and an opening edge of the fitting groove squeeze against each other to restrict rattling of the housings.

A projecting dimension of the rattling preventing rib is specified to correspond to a clearance between the housings. However, the clearance between the housings is small. Thus, a large projecting dimension of the rattling preventing rib cannot be ensured, and molding is difficult. If the projecting dimension of the rattling preventing rib is reduced, the rattling preventing rib may be squeezed excessively by pressure from the side of the receptacle and a function of restricting the rattling of the housings may not be fulfilled.

The invention was completed on the basis of the above situation to provide a connector that improves molding freedom and durability of a structure for suppressing rattling of housings.

SUMMARY

The invention is directed to a connector with a first housing to be connected to a second housing. The first housing includes a tubular receptacle and two side walls are formed on both circumferential ends of the receptacle. A lock arm is between the side walls and holds the second housing in a connected state. An entrance space is formed between the side wall and the lock arm, and a part of the second housing enters the entrance space. A fitting space communicates with the entrance space, and another part of the second housing enters the fitting space in the receptacle. A protrusion is formed on at least one of facing surfaces of the side walls and contacts the part of the second housing when connected to the second housing.

The protrusion contacts the part of the second housing to suppress rattling between the properly connected first and second housings. The entrance space between the side wall and the lock arm communicates with the fitting space. Thus, a pressure exerted by the side wall on the part of the second housing can be reduced when the part of the second housing is in the entrance space. As a result, the protrusion is not squeezed and is more durable. Further, reducing the pressure acting on the protrusion enables a projecting dimension of the protrusion to be increased and enhances a degree of molding freedom of the protrusion.

The protrusion may have a flat end surface configured to come into surface contact with the part of the second housing. Accordingly, the end surface of the protrusion is less likely to be squeezed, and the housings are less likely to rattle.

The entrance space may be open to the outside on a side opposite to the fitting space. Thus, a worker can see the protrusion through the entrance space after the housings are connected and can determine if the protrusion is functioning properly without being squeezed.

The protrusions may include a preceding protrusion configured to contact the part of the second housing in an initial stage of connection of the first and second housings and a succeeding protrusion configured to contact the part of the second housing in a final stage of connection of the first and second housings. A connection peak normally is set in a middle stage of connection of the housings. According to the above configuration, a connection peak can be set between contact resistance generated by the contact of the preceding protrusion with the part of the second housing in the initial stage of the connection of the housings and contact resistance generated by the contact of the succeeding protrusion with the part of the second housing in the final stage of the connection of the housings. Therefore, connection resistance can be dispersed in the entire connection process of the housings and a burden of a connecting operation can be alleviated.

DETAILED DESCRIPTION

An embodiment of the invention is described with reference to FIGS. 1 to 8. A connector of this embodiment includes a first housing 10 and a second housing 60 that are connectable to each other. In the following description, surfaces of the first and second housings 10 and 60 facing each other at the start of connection are referred to as front ends concerning a front-rear direction, and a vertical direction is based on a vertical direction in the figures except FIGS. 2 and 5. A width direction is synonymous with a lateral direction of FIGS. 4 and 6.

[Second Housing 60]

Figure 3:
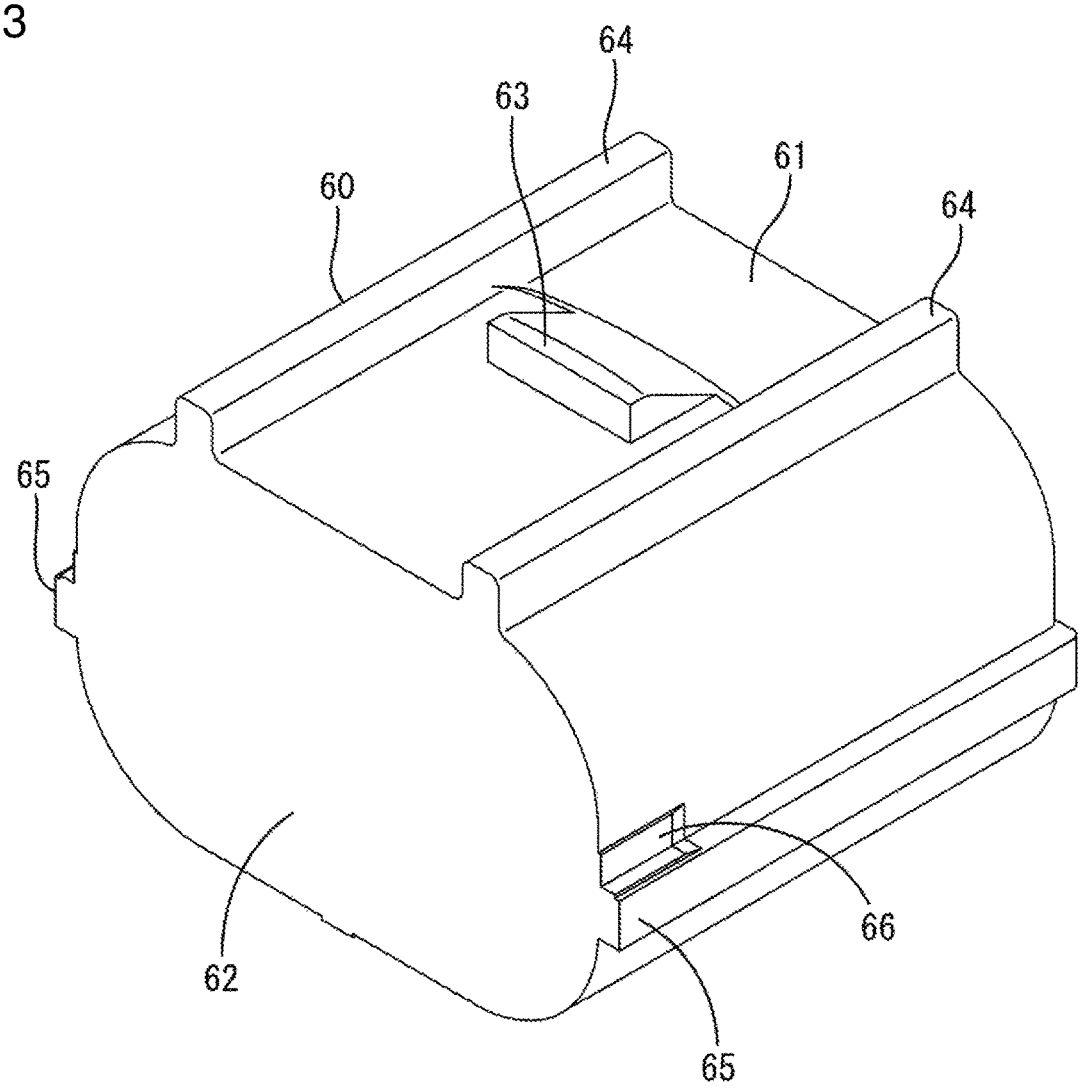
FIG. 3 is a perspective view of a second housing.
Figure 4:
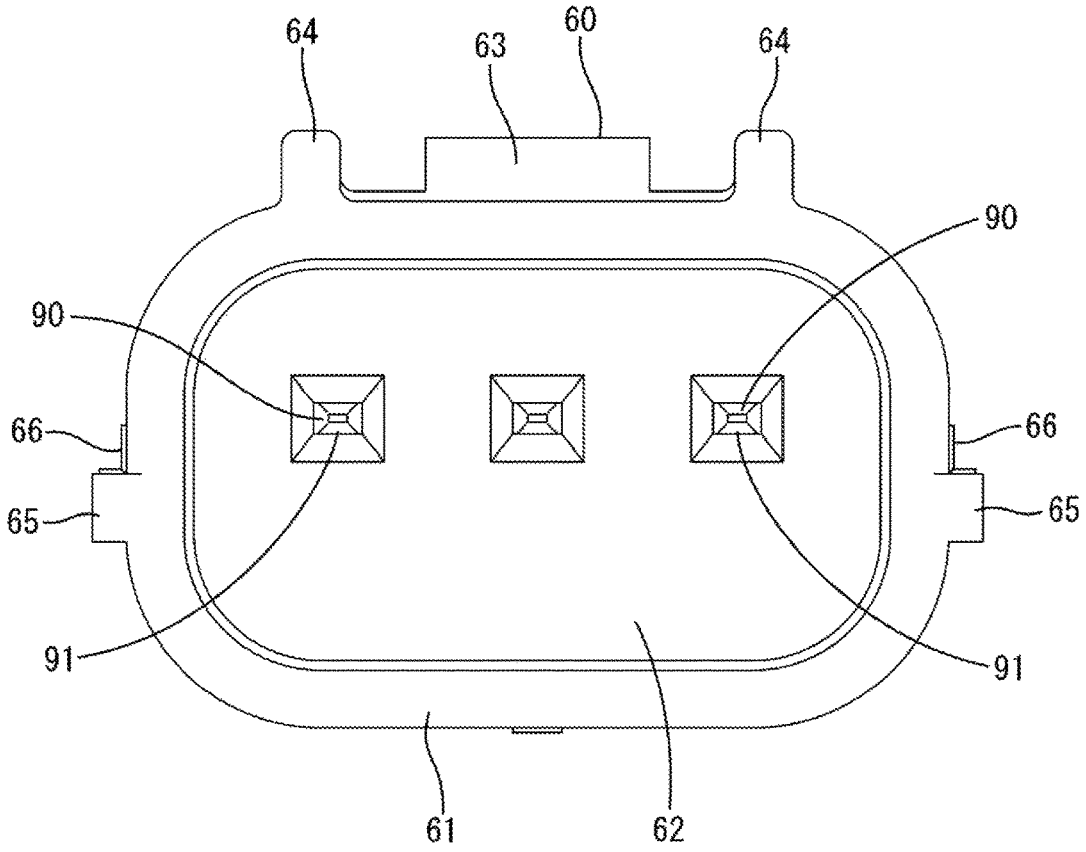
FIG. 4 is a front view of the second housing.

The second housing 60 is made of synthetic resin and is configured as a male housing into which male terminal fittings 90 are mountable. As shown in FIG. 3, the second housing 60 has a tube 61 projecting forward from a back wall 62. The back wall 62 is provided on an unillustrated device such as an engine and vibrates according to the vibration of the device. As shown in FIG. 4, tabs 91 of the male terminal fittings 90 penetrate through the back wall 62 and project into the tube 61. The tabs 91 are arranged laterally side by side in a row in the tube 61. Note that the tube 61 and the back wall 62 constitute a body part of the second housing 60.

An upper wall of the tube 61 is arranged along the width direction. A lock 63 projects in a widthwise central part of the outer surface (upper surface) of the upper wall of the tube 61. The lock 63 is in the form of a flat projection somewhat long in the width direction. Two walls 64 project on both widthwise end parts of the outer surface of the upper wall of the tube 61. As shown in FIG. 3, each wall 64 is in the form of a rib extending over the entire length in the front-rear direction on the upper wall of the tube 61. Each wall 64 has the same substantially rectangular cross-sectional shape in the front-rear direction and has a projecting dimension equal to or slightly larger than that of the lock 63. Note that the walls 64 constitute parts of the second housing 60.

As shown in FIG. 4, left and right side walls of the tube 61 are arranged along the vertical direction (height direction). Two lateral walls 65 project at positions slightly below central parts of outer surfaces in the height direction on the left and right side walls of the tube 61. As shown in FIG. 3, each lateral wall 65 is a rib extending over the entire length in the front-rear direction on the left or right side wall of the tube 61. Each lateral wall 65 has a substantially rectangular cross-sectional shape and has a projecting dimension smaller than that of each wall 64. Flat ribs 66 are provided on rear parts of the left and right side walls of the tube 61 and are padded to have a predetermined thickness from the upper surfaces of the respective lateral walls 65 to adjacent outer surface regions.

[First Housing 10]

Figure 1:
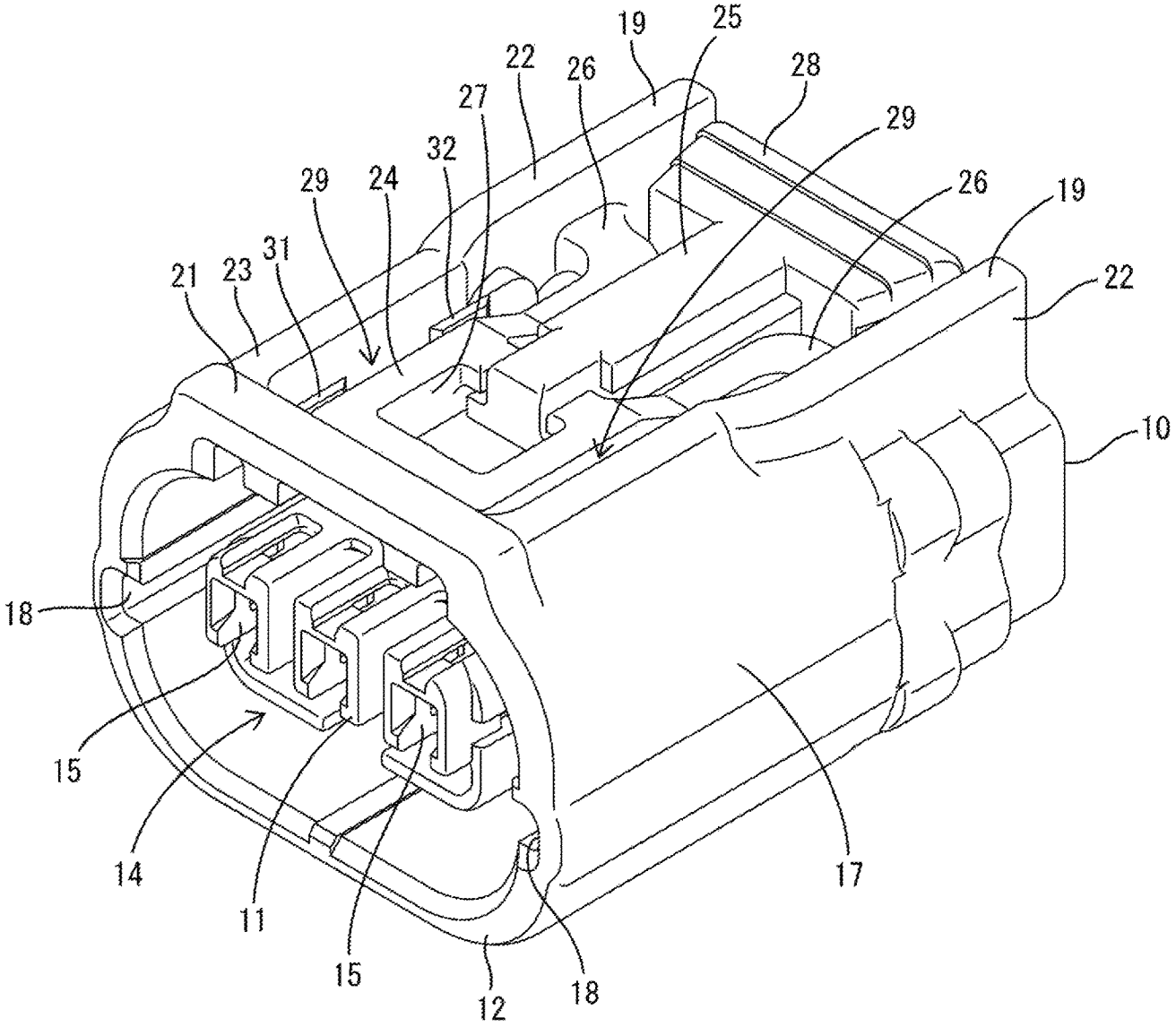
FIG. 1 is a perspective view of a first housing in a connector of one embodiment of the present invention.
Figure 7:
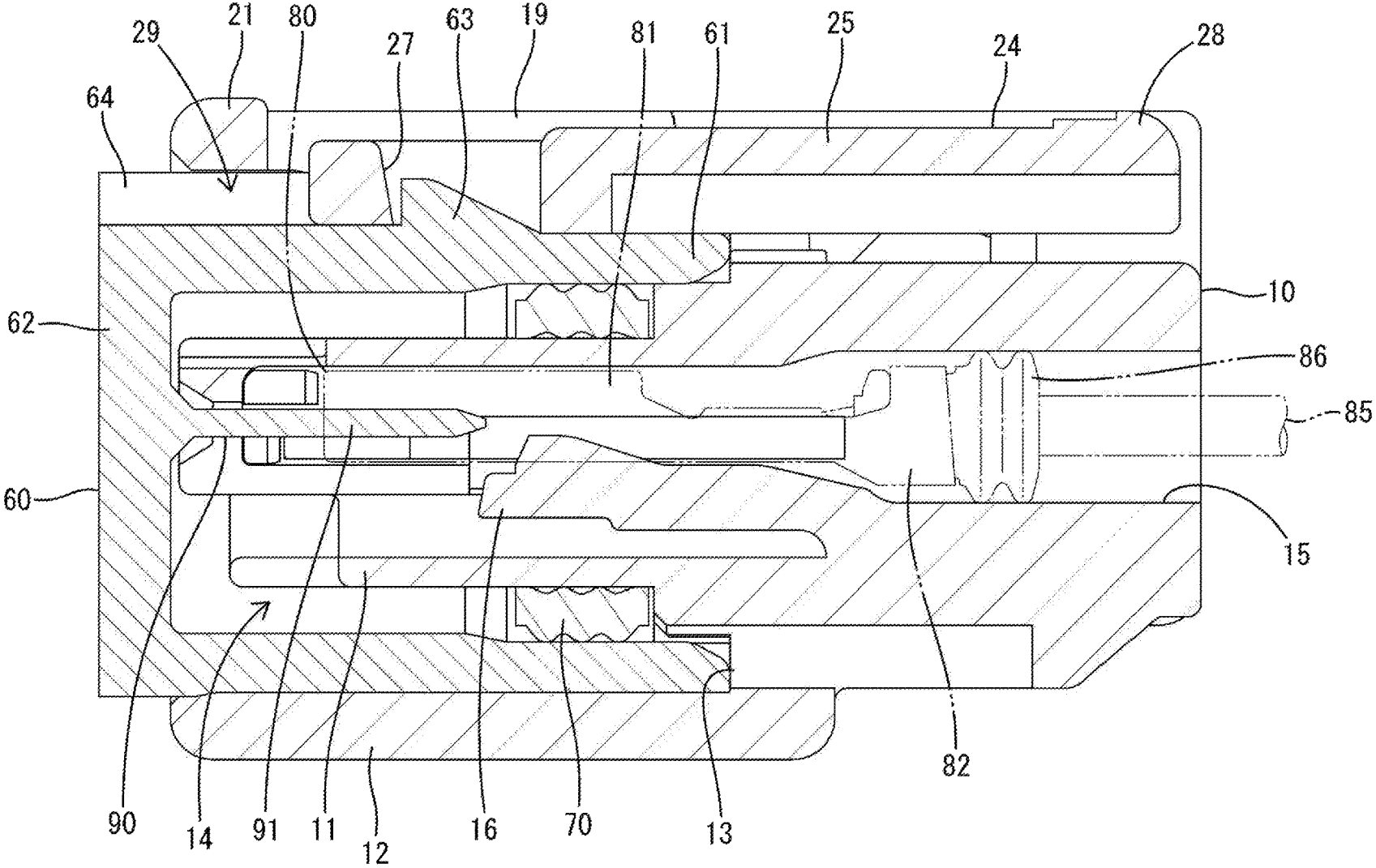
FIG. 7 is a side view in section showing the housings are connected to each other.
Figure 8:
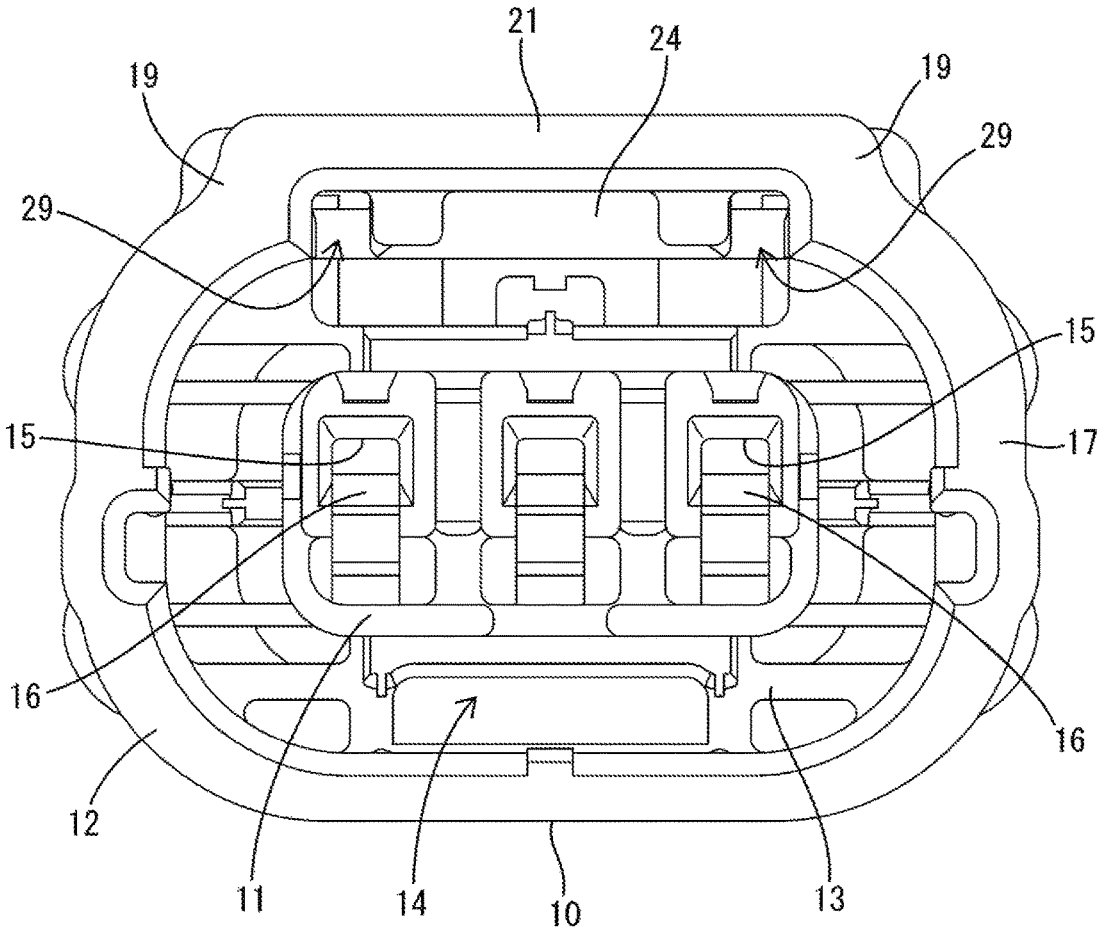
FIG. 8 is a front view of the first housing.

The first housing 10 is made of synthetic resin and is configured as a female housing capable of accommodating female terminal fittings 80. As shown in FIGS. 1 and 8, the first housing 10 includes a terminal accommodating portion 11 that is flat in the width direction, and a tubular receptacle 12 surrounds the outer periphery of the terminal accommodating portion 11. As shown in FIGS. 7 and 8, the receptacle 12 and the terminal accommodating portion 11 are coupled via a radially extending link 13. A seal ring 70 is fit in front of the link 13 on the outer surface of the terminal accommodating portion 11. A fitting space 14 is provided in the receptacle 12 and can receive the second housing 60. The tube 61 of the second housing 60 is fit externally on the terminal accommodating portion 11 in the fitting space 14. The seal ring 70 is held in close contact with the inner surface of the tube 61 and the outer surface of the terminal accommodating portion 11, thereby sealing between the housings 10, 60 in a liquid-tight manner.

Figure 6:
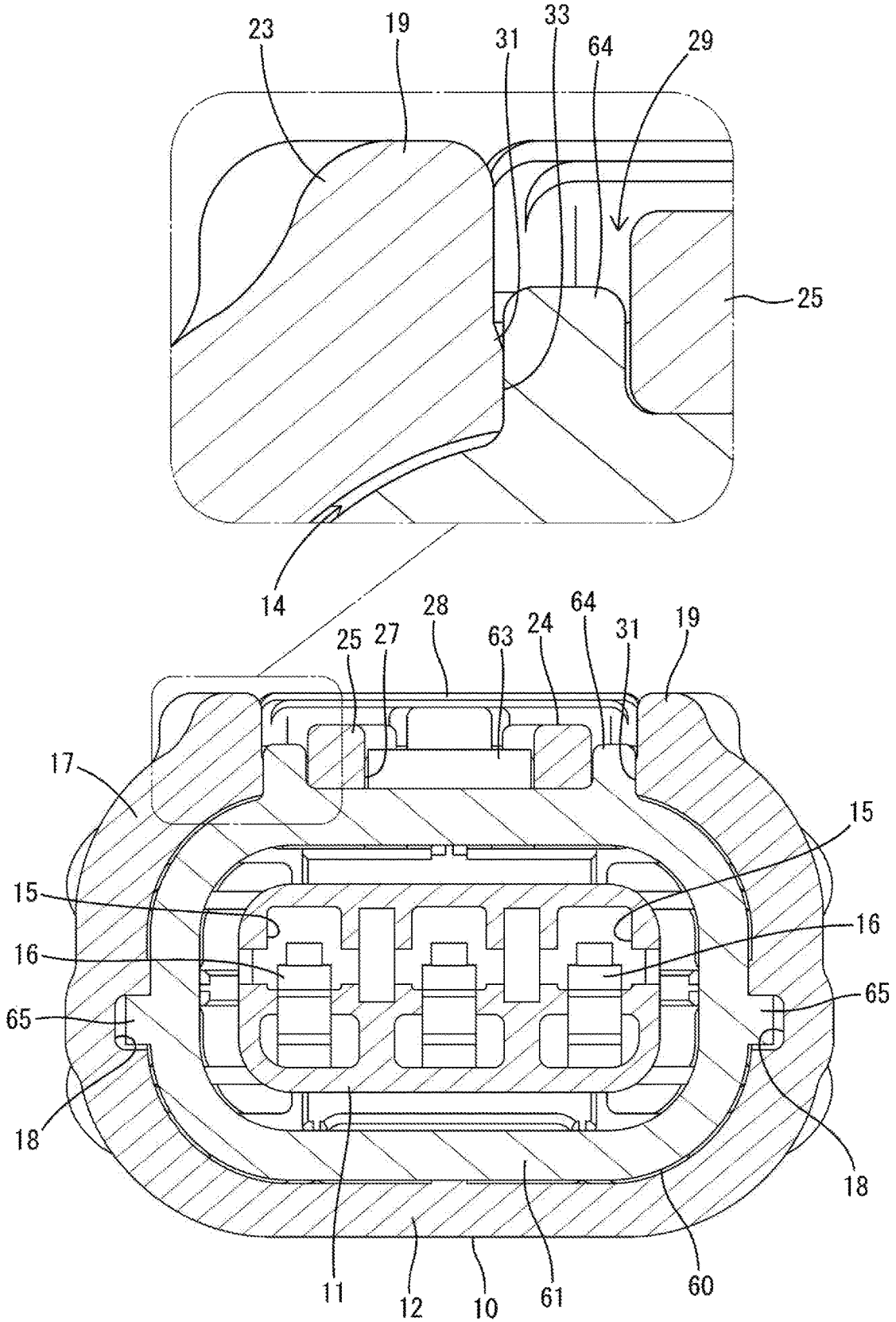
FIG. 6 is a lateral section and an enlarged view of an essential part showing the state where the both housings are connected to each other.

Cavities 15 penetrate the terminal accommodating portion 11 in the front-rear direction. As shown in FIGS. 1 and 6, the cavities 15 are arranged laterally side by side in a row in the terminal accommodating portion 11. As shown in FIG. 7, a deflectable locking lance 16 projects forward from on the inner surface of each cavity 15.

Female terminal fitting 80 are inserted respectively into the cavities 15 of the first housing 10 from behind. Each female terminal fitting 80 is made of conductive metal and, as shown in FIG. 7, is connected to an end part of a wire 85 and includes a tubular connecting portion 81 in a front part. The tab 91 of the male terminal fitting 90 is inserted into the connecting portion 81 for connection. The locking lance 16 locks the connecting portion 81 to retain the female terminal fitting 80 in the cavity 15. A rubber plug 86 is fit on the wire 85 and closely contacts the inner surface of a rear part of the cavity 15 to seal the cavity 15 in a liquid-tight manner while being held in a barrel 82 of the female terminal fitting 80. An unillustrated front retainer is mounted on the front surface of the terminal accommodating portion 11 and functions to restrict the deflection of the locking lances 16 and to prevent the escape of the female terminal fittings 80 from the cavities 15.

Figure 2:
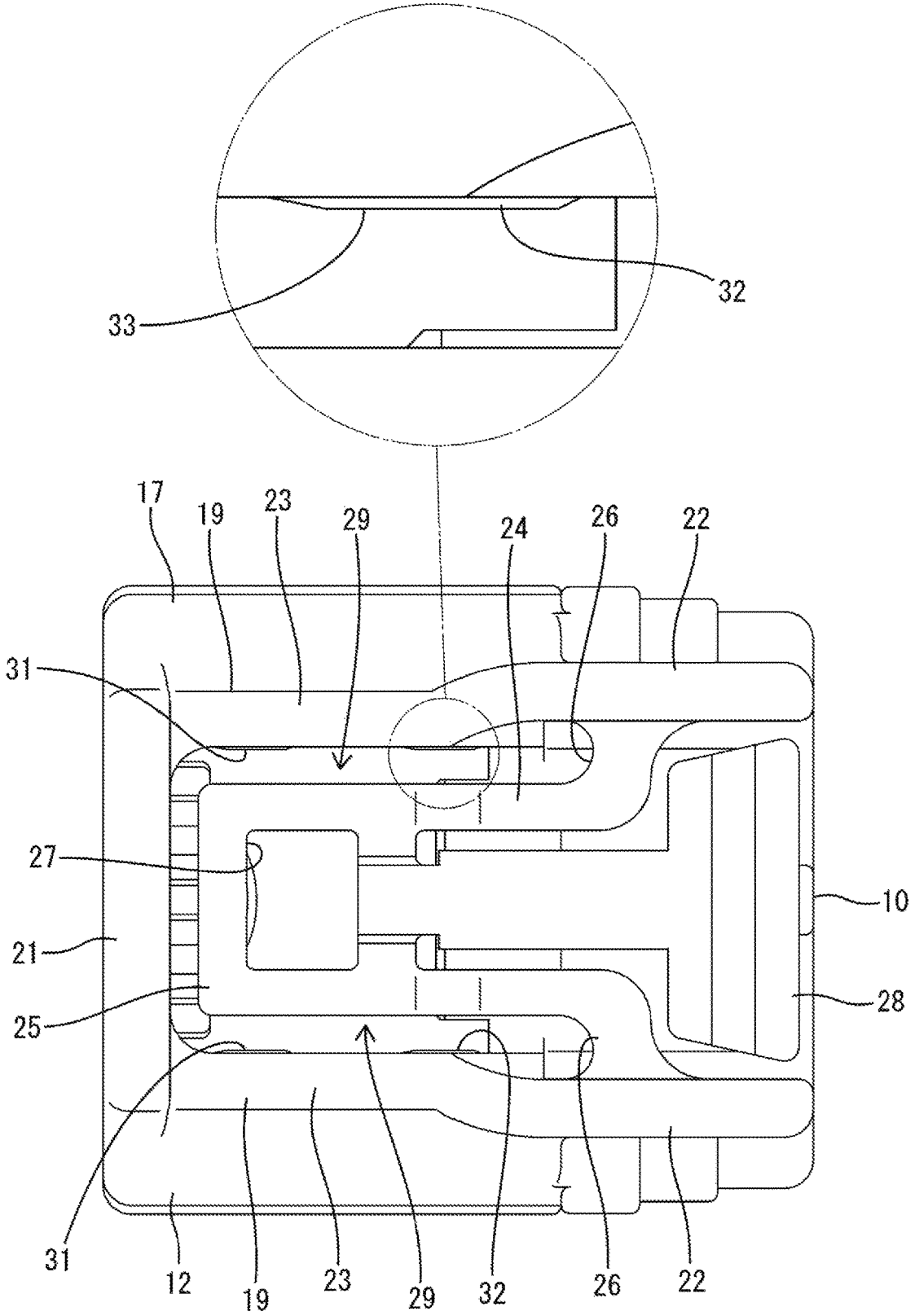
FIG. 2 is a plan view of the first housing.

As shown in FIGS. 1 and 2, the receptacle 12 has an open upper part and includes a peripheral wall 17 continuous in a circumferential direction except at the upper part. As shown in FIG. 6, the peripheral wall 17 is shaped to correspond to the outer periphery of the tube 61 and includes grooves 18 on left and right sides of the inner surface. Each groove 18 has a concave cross-section, extends in the front-rear direction and is open in the front end of the peripheral wall 17. The lateral walls 65 are insertable respectively into the grooves 18 of the peripheral wall 17.

As shown in FIG. 8, side walls 19 rise from both circumferential ends of the peripheral wall 17 of the first housing 10 and a bridge 21 laterally bridges between front ends of the respective side walls 19. The side walls 19 form ribs extending over the entire length in the front-rear direction on the both circumferential ends of the peripheral wall 17 and are formed so that rear parts 22 are wider apart than front parts 23, as shown in FIG. 2.

As shown in FIGS. 1 and 2, the first housing 10 includes a lock arm 24 between the side walls 19. The lock arm 24 includes a plate-like arm body 25 located behind the bridge 21 and coupling portions 26 connect left and right sides of the arm body 25 to the respective side walls 19. The arm body 25 extends in the front-rear direction above the fitting space 14, and a lock hole 27 penetrates through a front part of the arm body 25. A releasing portion 28 is provided on a rear part of the arm body 25 and protrudes toward both widthwise sides. As shown in FIG. 7, the lock 63 is fit into the lock hole 27 of the arm body 25 to hold the housings 10, 60 in a connected state. Pressing the releasing portion 28 from above causes the lock 63 to come out of the lock hole 27 so that the housings 10, 60 can be separated.

The side walls 19 cover the arm body 25 from both left and right sides. As shown in FIGS. 1, 2 and 6, entrance spaces 29 are defined between left and right sides of the arm body 25 and the respective side walls 19, and the walls 64 enter the entrance spaces 29 when the housings 10, 60 are connected. Each entrance space 29 communicates with the fitting space 14 below and is open upward. A width of each entrance space 29 on a front side is substantially equal to a thickness (width) of each wall 64. Note that the inner surfaces of the side walls 19 face each other.

Figure 5:
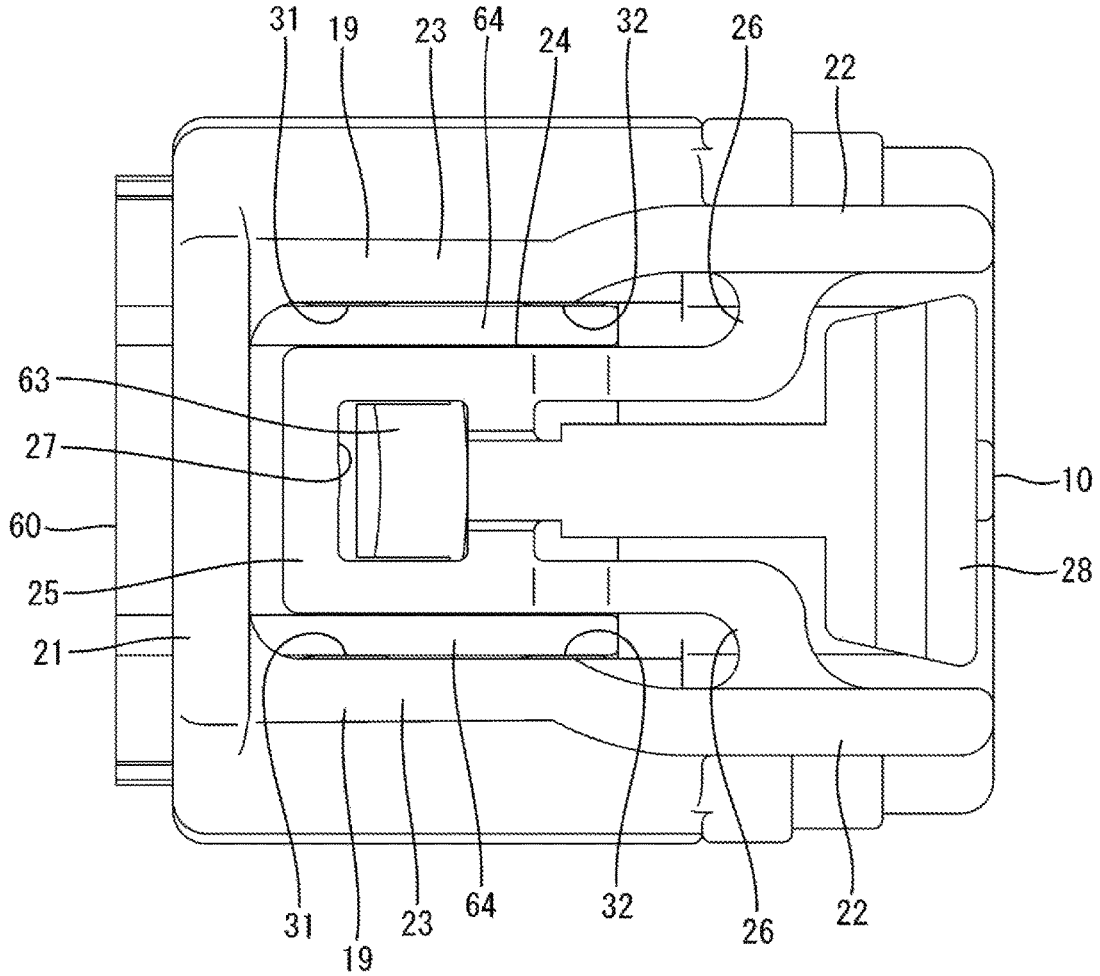
FIG. 5 is a plan view showing the housings connected to each other.

The inner surfaces (facing surfaces and surfaces opposed to the respective walls 64) of the front parts 23 of the side walls 19 extend vertically and along the front-rear direction. Protrusions 31, 32 are provided on the inner surfaces of the front parts 23. As shown in FIG. 2, the protrusions 31, 32 comprise two preceding protrusions 31 projecting in lower parts on front ends of the inner surfaces of the front parts 23 and two succeeding protrusions 32 projecting in lower parts on rear ends of the inner surfaces of the front parts 23. Each protrusion 31, 32 has a flat trapezoidal shape with a flat end surface 33 along the front-rear direction and the vertical direction at an inner side in a projecting direction, and the front, rear, left and right surfaces thereof are inclined to taper the protrusion 31, 32 toward the end surface 33. Each of the protrusions 31, 32 is below the bridge 21 with respect to the vertical direction. Each preceding protrusion 31 is at a position overlapping the lock hole 27 with respect to the front-rear direction. Each succeeding protrusion 32 is behind the lock hole 27 with respect to the front-rear direction. As shown in FIG. 5, each of the protrusions 31, 32 is in the entrance space 29, fills up a clearance between each wall 64 that enters each entrance space 29 and brings the end surface 33 into contact with each wall 64.

[Connection Structure and Functions]

The tube 61 of the second housing 60 is fit into the fitting space 14 of the first housing 10. In an initial stage of the connection of the housings 10, 60, the lateral walls 65 enter the respective grooves 18, the walls 64 enter the respective entrance spaces 29 and the end surfaces 33 of the preceding protrusions 31 slide on the outer surfaces (surfaces opposed to the side walls 19) of the respective walls 64. Thus, the walls 64 are pressed against the respective preceding protrusions 31 and the preceding protrusions 31 are pressed against the respective walls 64. However, base end parts of the side walls 19 are coupled only to the peripheral wall 17 and an area between the base end parts of the side walls 19 in an upper part of the peripheral wall 17 is open as a communication area with the lock arm 24 and the fitting space 14. Further, the base end parts of the side walls 19 are slightly resilient and can deform to bulge out. Similarly, the respective walls 64 also can be deformed resiliently to tilt with base end parts thereof as fulcrums. Thus, pressures acting on the preceding protrusions 31 from the respective walls 64 are allowed to escape so that the preceding protrusions 31 are not squeezed by the pressures receiving from the walls 64.

In a middle stage of the connection of the housings 10, 60, the tabs 91 of the male terminal fittings 90 enter the connecting portions 81 of the respective female terminal fittings 80 for connection. Additionally, the arm body 25 interferes with the lock 63 and the lock arm 24 is deflected and deformed with the couplings 26 as supports. Thus, a peak of a connecting force (connection peak) appears during the connection of the housings 10, 60.

In a final stage of the connection, the end surfaces 33 of the succeeding protrusions 32 hit the outer surfaces of the respective walls 64. Base end parts of the side walls 19 are slightly resilient, and hence the succeeding protrusions 32 are not squeezed by the pressures received from the respective walls 64, similarly to the respective preceding protrusions 31. The succeeding protrusions 32 contact the outer surfaces of the respective walls 64 at a timing later than the connection peak during the connection of the housings 10, 60. Thus, contact resistance generated when the succeeding protrusions 32 contact the outer surfaces of the walls 64 is not added to the connection peak, and the connecting force does not increase at once in a connection process of the housings 10, 60.

The lock arm 24 resiliently returns and the lock 63 is fit into the lock hole 27 (see FIGS. 5 to 7) when the housings 10, 60 are connected properly. At this time, the female terminal fittings 80 and the respective male terminal fittings 90 are connected properly electrically (see FIG. 7). Further, the flat ribs 66 firmly contact the inner surfaces of the respective grooves 18.

With the housings 10, 60 properly connected, the walls 64 cover the arm body 25 from both left and right sides and are sandwiched between the left and right side parts of the arm body 25 and the respective side walls 19. The end surfaces 33 of the respective preceding protrusions 31 and those of the respective succeeding protrusions 32 are in contact with the respective walls 64 while being spaced apart in the front-rear direction. A worker can visually confirm the respective walls 64, the respective preceding protrusions 31 and the respective succeeding protrusions 32 through the entrance spaces 29 from above. Note that the walls 64 function to guide a connecting operation of the housings 10, 60 together with the respective lateral walls 65.

Even if the device vibrates and a vibration force thereof is transmitted to the housings 10, 60 after the connection of the housings 10, 60, a state where the end surfaces 33 of the preceding protrusions 31 and those of the succeeding protrusions 32 are in contact with the respective walls 64 is maintained, and a state where the flat ribs 66 are in contact with the inner surfaces of the respective grooves 18 is maintained. Thus, the rattling of the first housing 10 with respect to the second housing 60 can be suppressed. As a result, the wear of the female terminal fittings 80 and the male terminal fittings 90 due to vibration can be prevented. Particularly, since the preceding protrusions 31 and the succeeding protrusions 32 are spaced apart and paired at four positions symmetrical across the lock hole 27 of the arm body 25 in a plan view, the rattling of the housings 10, 60 can be suppressed more.

As described above, the entrance spaces 29 are defined between the left and right side parts of the arm body 25 and the side walls 19 and communicate with the fitting space 14. Thus, pressures received by the respective walls 64 from the respective side walls 19 with the walls 64 located in the entrance spaces 29 can be reduced, and a situation where the preceding protrusions 31 and the succeeding protrusions 32 are squeezed can be avoided. As a result, the durability of the preceding protrusions 31 and the succeeding protrusions 32 can be improved. Further, a degree of molding freedom of the preceding protrusions 31 and the succeeding protrusions 32 can be enhanced.

The flat end surfaces 33 of the preceding protrusions 31 and the succeeding protrusions 32 are held in surface contact with the outer surfaces of the respective walls 64. Thus, the preceding protrusions 31 and the succeeding protrusions 32 are less likely to be squeezed as compared to the case of point contact or line contact, and reliability in suppressing the rattling of the housings 10, 60 can be improved.

Further, the entrance spaces 29 are open upward (side opposite to the fitting space 14). Therefore, the worker can see the preceding protrusions 31 and the succeeding protrusions 32 through the entrance spaces 29 and confirm whether or not the preceding protrusions 31 and the succeeding protrusions 32 are properly functioning without being squeezed after the connection of the housings 10, 60.

Further, the preceding protrusions 31 contact the outer surfaces of the respective walls 64 to generate contact resistance in the initial stage of the connection, the succeeding protrusions 32 contact the outer surfaces of the respective walls 64 to generate contact resistance in the final stage of the connection and the connection peak is in the middle stage of the connection. Thus, connection resistance can be dispersed in the entire connection process of the housings 10, 60, and a burden of the connecting operation can be alleviated.

Other embodiments are described briefly below.

Contrary to the above embodiment, the first housing may be a male housing into which male terminal fittings are mounted and in which tabs project into a receptacle. The second housing may be a female housing capable of accommodating female terminal fittings.

The protrusions may be provided only on one of the facing surfaces of the respective side walls.

The protrusions may be provided on each of the opposed (facing) surfaces of both side walls and the respective walls.

The protrusions may be at only one position in the front-rear direction of the first housing without being divided into the preceding protrusions and the succeeding protrusions.

The protrusions may include other protrusions spaced apart in the front-rear direction in addition to the preceding protrusions and the succeeding protrusions.

The protrusions may be sandwiched in a slightly squeezed state between the walls and the side walls after the connection of the housings.

LIST OF REFERENCE SIGNS

10 . . . first housing
12 . . . receptacle
14 . . . fitting space
19 . . . side wall
24 . . . lock arm
29 . . . entrance space
31 . . . preceding protrusion (protrusion)
32 . . . succeeding protrusion (protrusion)
60 . . . second housing
64 . . . wall (part of second housing)

What is claimed is:

1. A connector with a first housing to be connected to a second housing, the second housing having a tube and at least one wall projecting from the tube, wherein the first housing includes:

a tubular receptacle open in a forward direction;

two side walls formed on circumferential ends of the receptacle and extending in forward to backward directions;

a lock arm arranged between the side walls, the lock arm holding the second housing in a connected state;

entrance spaces formed between the side walls and the lock arm, and the at least one wall of the second housing entering at least one of the entrance spaces;

a fitting space communicating with the entrance spaces, the tube of the second housing entering the fitting space in the receptacle; and at least one preceding protrusion formed on at least one of facing surfaces of the side walls, the at least one preceding protrusion being at a forward end of the side walls and at least one succeeding protrusion formed on at least one of the facing surfaces of the side walls at a position spaced rearward from the at least one preceding protrusion, wherein the at least one preceding protrusion contacts the at least one wall of the second housing at an initial stage of connection of the first and second housings and slides along the at least one wall until the first and second housings are in a connected state, and the at least one succeeding protrusion contacts the at least one wall in a final stage of the connection of the first housing and the second housing.

2. The connector of claim 1, wherein the entrance space is open to outside on a side opposite to the fitting space.

3. The connector of claim 1, wherein the at least one preceding protrusion and the at least one succeeding protrusion have flat end surfaces configured to come into surface contact with the at least one wall of the second housing.

4. The connector of claim 3, wherein the entrance space is open to outside on a side opposite to the fitting space.

* * * * *